US009940889B2

(12) United States Patent
Park et al.

(10) Patent No.: US 9,940,889 B2
(45) Date of Patent: Apr. 10, 2018

(54) GATE DRIVING CIRCUIT AND DISPLAY DEVICE INCLUDING THE SAME

(71) Applicant: SAMSUNG DISPLAY CO., LTD., Yongin-si, Gyeonggi-do (KR)

(72) Inventors: Jun Hyun Park, Yongin-si (KR); Sung Hwan Kim, Yongin-si (KR); Kyoung Ju Shin, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 15/172,060

(22) Filed: Jun. 2, 2016

(65) Prior Publication Data

US 2016/0365052 A1 Dec. 15, 2016

(30) Foreign Application Priority Data

Jun. 15, 2015 (KR) ..... 10-2015-0084516

(51) Int. Cl.
*G09G 3/36* (2006.01)

(52) U.S. Cl.
CPC ... *G09G 3/3677* (2013.01); *G09G 2310/0286* (2013.01); *G09G 2330/021* (2013.01)

(58) Field of Classification Search
None
See application file for complete search history.

(56) References Cited

U.S. PATENT DOCUMENTS 8,304,300 B2 11/2012 Sakata et al.
9,093,542 B2 7/2015 Maeda et al.
2013/0335392 A1* 12/2013 Cho ..... H03K 3/00 345/211
2015/0029082 A1* 1/2015 Jeon ..... G11C 19/28 345/98
2015/0206490 A1* 7/2015 Lim ..... G09G 3/3677 345/92
2015/0228353 A1* 8/2015 Qing ..... G11C 19/28 377/75

FOREIGN PATENT DOCUMENTS

JP 2011-29635 A 2/2011
KR 10-2014-0024994 A 3/2014
KR 10-2015-0011910 A 2/2015

* cited by examiner

*Primary Examiner* — Christopher Kohlman

(74) *Attorney, Agent, or Firm* — Lewis Roca Rothgerber Christie LLP

(57) ABSTRACT

A gate driving circuit including a plurality of stage circuits to output a plurality of gate signals, a N-th stage circuit of the plurality of stage circuits includes: an output pull-up part including a control electrode connected to a first node, the first node being configured to have a potential increase in response to a (N−1)-th control signal received from a previous stage circuit of the N-th stage circuit, the output pull-up part to receive a clock signal to output a gate signal of the N-th stage circuit; a control node pull-up part to control the potential of the first node by using the (N−1)-th control signal; and a control node pull-down part to discharge the first node to a second low voltage according to a (N+1)-th control signal, wherein the output pull-up part is to discharge the gate signal of the N-th stage circuit in a (N+2)-th stage circuit.

10 Claims, 4 Drawing Sheets

GATE DRIVING CIRCUIT AND DISPLAY DEVICE INCLUDING THE SAME

CROSS-REFERENCE TO RELATED APPLICATION

This application claims priority to and the benefit of Korean Patent Application No. 10-2015-0084516, filed on Jun. 15, 2015, in the Korean Intellectual Property Office, the entire content of which is incorporated herein by reference in its entirety.

BACKGROUND

1. Field

One or more aspects of example embodiments relate to a liquid crystal display, and more particularly, to a gate driving circuit of the liquid crystal display.

2. Description of the Related Art

Display devices such as liquid crystal displays (LCDs), organic light emitting diode (OLED) displays, electrophoretic displays, and plasma displays include a plurality of field generating electrodes and electro-optical active layers therebetween. The LCD includes a liquid crystal layer as an electro-optical active layer, and the OLED display includes an organic emission layer as an electro-optical active layer. One of the field generating electrodes is generally connected to a switching element to receive an electrical signal, and the electro-optical active layer converts the received electrical signal into an optical signal to display an image.

A panel display device may include a display panel in which a thin film transistor is formed. Multiple layers of electrodes, semiconductors, and the like are patterned in a thin film transistor array panel, and a mask is generally used in a patterning process.

The semiconductor is an important factor in determining the characteristics of the thin film transistor. The semiconductor is substantially formed of amorphous silicon, but due to low charge mobility thereof, there may be a limit on manufacturing a high performance thin film transistor. Further, when polysilicon is used, the high performance thin film transistor may be easily manufactured due to high charge mobility, but the cost of manufacturing may be high and display uniformity may be low, thereby making it difficult to manufacture a large-sized thin film transistor array panel.

Accordingly, a thin film transistor using an oxide semiconductor having high charge mobility and a high ON/OFF current ratio compared to that of amorphous silicon, in addition to having a low cost of manufacturing and high display uniformity compared to that of polysilicon, has been researched.

Further, to reduce a size of the display panel and to increase productivity, a method in which a gate driving circuit that outputs a gate signal to be supplied to a gate line formed on the display panel that is integrated on the display panel has been developed. The gate driving circuit integrated on the display panel may include a thin film transistor manufactured through the same or substantially the same process as that of the thin film transistor for a pixel, and thus, the active layer of the thin film transistor of the gate driving circuit may also be formed of an oxide semiconductor.

The above information disclosed in this Background section is only for enhancement of understanding of the background of the invention, and therefore, may constitute information that does not form prior art.

SUMMARY

Aspects of example embodiments of the present invention are directed toward a gate driving circuit in which an output pull-down transistor is omitted to reduce a bezel size.

According to an exemplary embodiment of the present invention a gate driving circuit including a plurality of stage circuits configured to output a plurality of gate signals is provided, a N-th stage circuit (N being a natural number) of the plurality of stage circuits including: an output pull-up part including a control electrode connected to a first node, the first node being configured to have a potential increase in response to a (N−1)-th control signal received from a previous stage circuit of the N-th stage circuit, the output pull-up part being configured to receive a clock signal to output a gate signal of the N-th stage circuit; a control node pull-up part configured to control the potential of the first node by using the (N−1)-th control signal; and a control node pull-down part configured to discharge the first node to a first low voltage according to a (N+1)-th control signal, wherein the output pull-up part is configured to discharge the gate signal of the N-th stage circuit in a (N+2)-th stage circuit.

The N-th stage circuit may further include a carry part configured to output a high voltage of the clock signal as a N-th control signal when a high voltage is supplied to the first node.

The N-th stage circuit may further include an inverter part configured to output the clock signal to an inverting node during a remaining period excluding a period in which a high voltage of a N-th control signal is outputted.

The N-th stage circuit may further include a carry holding part configured to discharge a carry output terminal of a carry part to the second low voltage when the clock signal is supplied to the inverting node, the carry part being configured to output a N-th control signal.

The N-th stage circuit may further include a carry pull-down part configured to discharge a carry output terminal to the second low voltage corresponding to the (N+1)-th control signal.

The N-th stage circuit may further include a control node holding part configured to discharge the first node to the second low voltage when the clock signal is supplied to the inverting node.

The N-th stage circuit may further include an output holding part configured to discharge an output node configured to output the gate signal of the N-th stage circuit to a first low voltage when the clock signal is supplied to the inverting node.

A pull-down time of the output pull-up part may be longer than a pull-down time of the carry pull-down part.

The control node pull-up part may include a first transistor and a second transistor, gate electrodes of each of the first and second transistors being configured to receive the (N−1)-th control signal, and an input electrode of the first transistor may be configured to receive the (N−1)-th control signal, and an input electrode of the second transistor may be configured to receive an output of the first transistor.

According to another exemplary embodiment of the present invention, a display device includes: a display panel including: a display area including a plurality of gate lines, a plurality of data lines, and a plurality of pixel transistors; and a peripheral area surrounding the display area; a data driving circuit configured to output data signals to the data lines; and a plurality of stage circuits arranged at the peripheral area and configured to output gate signals to the gate lines, wherein each of the plurality of the stage circuits includes a gate driving circuit including a plurality of transistors, and wherein each of the plurality of the stage circuits includes: an output pull-up part including a control electrode connected to a first node, the first node being configured to have a potential increase in response to a (N−1)-th control signal received from a previous stage circuit of a N-th stage circuit, and the output pull-up part being configured to receive a clock signal to output a gate signal of the N-th stage circuit; a control node pull-up part configured to control the potential of the first node by using the (N−1)-th control signal; and a control node pull-down part configured to discharge the first node to a first low voltage according to a (N+1)-th control signal, wherein the output pull-up part is configured to discharge the gate signal of the N-th stage circuit in a (N+2)-th stage circuit.

The pixel transistors of the display area and the transistors of the gate driving circuits each may include an oxide semiconductor.

A gate electrode of a transistor of the control node pull-down part may be connected to an output of a transistor with a slowest discharge speed among a plurality of transistors connected to the first node.

The gate driving circuit may include the output pull-up part, the control node pull-up part, and the control node pull-down part, and a discharging time of the gate signal of the gate driving circuit may be longer than a pull-down time of the control signal.

According to one or more exemplary embodiments of the present invention, since the number of transistors included in a gate driving circuit may be reduced, it may be possible to reduce a bezel size and to reduce power consumption.

BRIEF DESCRIPTION OF THE DRAWINGS

Example embodiments will now be described more fully hereinafter with reference to the accompanying drawings. However, the present invention may be embodied in various different forms, and should not be construed as being limited to the embodiments set forth herein. Rather, these embodiments are provided so that this disclosure will be thorough and complete and will fully convey the aspects and features of the present invention to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Exemplary embodiments of the present disclosure will be described below in more detail with reference to the accompanying drawings.

In describing the exemplary embodiments of the present invention, processes, elements, and techniques that are not necessary to those having ordinary skill in the art for a complete understanding of the aspects and features of the present invention may not be described.

The aspects and features of the present invention, will be made clear by referring to the exemplary embodiments described below in more detail with reference to the accompanying drawings. However, the present invention is not limited to the exemplary embodiments described below.

It will be understood that a transistor used in a driving circuit may include three electrodes, which are referred to as a control electrode, an input electrode, and an output electrode. In various exemplary embodiments, the control electrode may be a gate electrode of the transistor, the input electrode may be a source electrode of the transistor, and the output electrode may be a drain electrode of the transistor.

Figure 1:
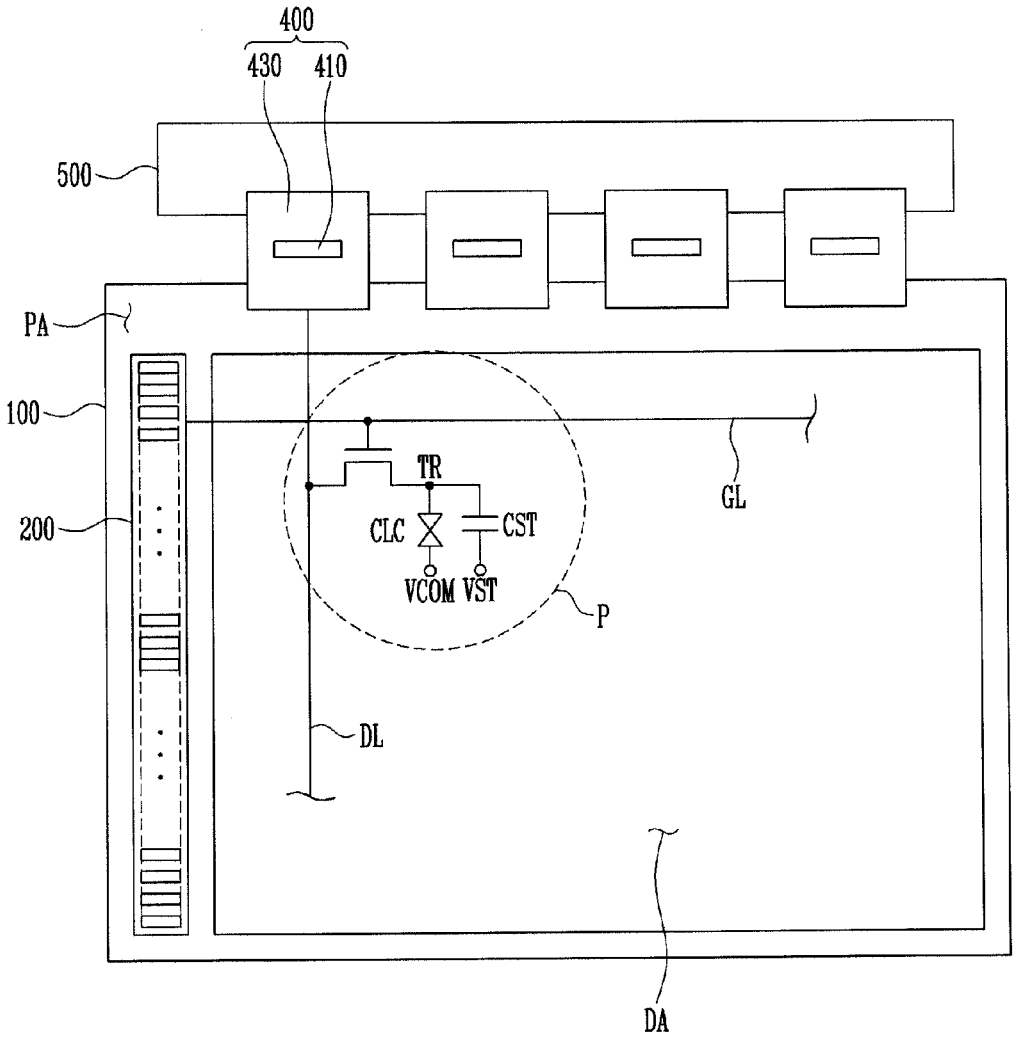
FIG. 1 illustrates a top plan view of a display device according to an exemplary embodiment.

FIG. 1 is a top plan view of a display device according to an exemplary embodiment.

Referring to FIG. 1, the display device includes a display panel 100, a gate driving circuit 200, a data driving circuit 400, and a printed circuit board 500.

The display panel 100 includes a display area DA, and a peripheral area PA surrounding the display area DA. Gate lines and data lines that cross each other and a plurality of pixels are formed at the display area DA. Each pixel P includes a pixel transistor TR electrically connected to a corresponding gate line GL and a corresponding data line DL, a liquid crystal capacitor CLC electrically connected to the pixel transistor TR, and a storage capacitor CST connected in parallel to the liquid crystal capacitor CLC. The pixel transistor TR may be an oxide transistor including an active layer made of an oxide semiconductor. The oxide semiconductor may be made of amorphous oxide including at least one selected from indium (In), zinc (Zn), gallium (Ga), tin (Sn), and hafnium (Hf). For example, the oxide semiconductor may be made of amorphous oxide including indium (In), zinc (Zn), and gallium (Ga), or of amorphous oxide including indium (In), zinc (Zn), and hafnium (Hf). The oxide semiconductor may include an oxide, such as indium zinc oxide (InZnO), indium gallium oxide (InGaO), indium tin oxide (InSnO), zinc tin oxide (ZnSnO), gallium tin oxide (GaSnO), gallium zinc oxide (GaZnO), and/or the like. For example, the active layer ACT may include indium gallium zinc oxide (IGZO).

The gate driving circuit 200 includes a shift register that sequentially outputs high-voltage gate signals to the gate lines. The shift register may include a plurality of stages (or a plurality of stage circuits). The gate driving circuit 200 is integrated on the peripheral area PA corresponding to one end of the gate lines. The gate driving circuit 200 includes a plurality of circuit transistors that are formed on the peripheral area PA by the same or substantially the same manufacturing process as that of the pixel transistor TR. The circuit transistor may be an oxide transistor including the oxide semiconductor as the active layer. The gate driving circuit 200 may be formed with a dual structure to correspond to opposite ends of the gate lines.

The data driving circuit 400 includes a data driving chip 410 for outputting data signals to the data lines, and a flexible circuit board 430 on which the data driving chip 410 is mounted to electrically connect the printed circuit board (PCB) 500 to the display panel 100.

Figure 2:
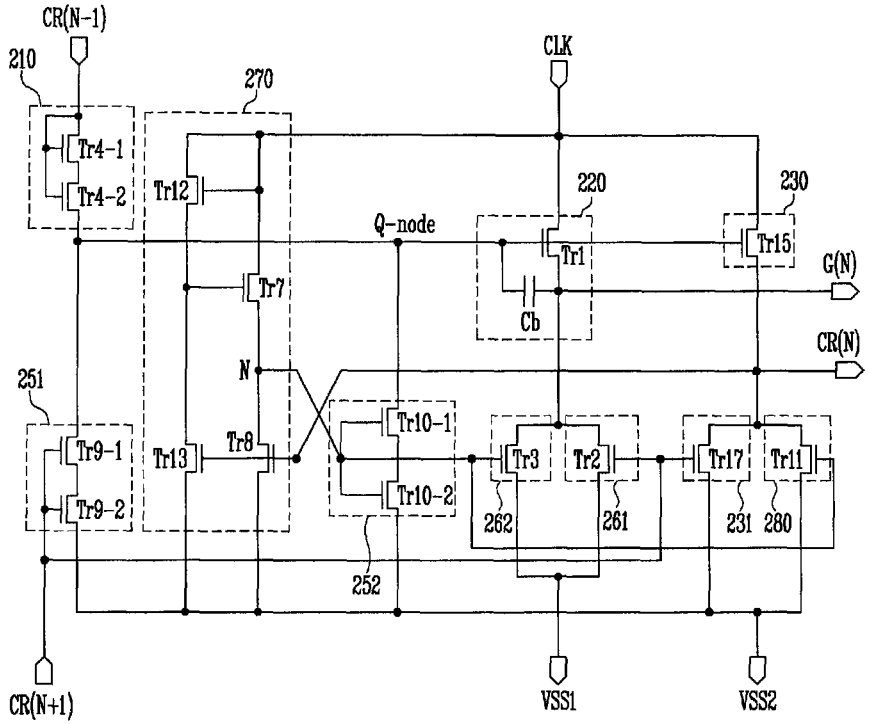
FIG. 2 illustrates a gate driving circuit diagram according to a comparative example.

FIG. 2 illustrates a gate driving circuit diagram according to a comparative example.

Referring to FIG. 2, a structure of the gate driving circuit desirably achieves a robust-operating characteristic and reduction of power consumption for a gate integrated circuit (IC) to which an oxide thin film transistor (TFT) is applied.

For example, according to a comparative amorphous silicon gate (ASG) circuit, low-level stress instead of high-level stress may be applied to a TFT by changing a circuit structure, and circuit-integrated efficiency may be improved.

Further, power consumption may be reduced by the structure of the gate driving circuit shown in FIG. 2. That is, increase of power consumption from leakage current occurring in the hold-transistor (or Hold TFT) due to the depletion characteristic of the oxide may be reduced by a serially-arranged TFT structure.

An operation of the gate driving circuit shown in FIG. 2 will now be described. The gate driving circuit 200 includes a shift register having a plurality of stages (or a plurality of stage circuits) that are dependently connected to each other.

Referring to FIG. 2, a n-th stage of the gate driving circuit according to the comparative example includes a Q-node pull-up unit (e.g., a Q-node pull-up part) 210, an output pull-up unit (e.g., an output pull-up part) 220, a carry unit (e.g., a carry circuit) 230, a carry pull-down unit (e.g., a carry pull-down part) 231, a Q-node pull-down unit (e.g., a Q-node pull-down part) 251, a Q-node holding unit (e.g., a Q-node holding part) 252, an output pull-down unit (e.g., an output pull-down part) 261, an output holding unit (e.g., an output holding part) 262, an inverter unit (e.g., an inverter part) 270, and a carry holding unit (e.g., a carry holding part) 280.

The Q-node pull-up unit 210 transmits a N−1th carry signal to the output pull-up unit 220. When receiving a high voltage of the N−1th carry signal, the Q-node pull-up unit 210 transmits a first voltage V1 corresponding to the received N−1th carry signal to a Q-node. The Q-node pull-up unit 210 may include a fourth transistor Tr4. The fourth transistor Tr4 includes an upper transistor Tr4-1 connected to an N−1th carry input terminal CR(N−1), and a lower transistor Tr4-2 connected to the upper transistor Tr4-1 in series. An output electrode of the lower transistor Tr4-2 is connected to the Q-node. The fourth transistor Tr4 may be configured by diode-connecting both transistors Tr4-1 and Tr4-2.

The output pull-up unit 220 outputs an N-th gate signal and includes a first transistor Tr1. The first transistor Tr1 includes a control electrode connected to the control node (Q-node), an input electrode connected to a clock terminal CLK, and an output electrode connected to an output node G(N).

When a high-voltage clock signal is transmitted to the clock terminal CLK in a state in which the first voltage V1 of the control node (Q-node) is applied to the control electrode of the output pull-up unit 220, the control node (Q-node) is boosted up to a boosting voltage from the first voltage V1. That is, the control node (Q-node) has a level of the first voltage during an (N−1)-th period, and a level of the boosting voltage during an Nth period.

While the boosting voltage is applied to the control electrode of the first transistor Tr1, the output pull-up unit 220 outputs a high-voltage clock signal as a high-voltage gate signal. The N-th gate signal is output through an output terminal connected to the output node G(N).

The carry unit 230 outputs an N-th carry signal, and includes a fifteenth transistor Tr15. The fifteenth transistor Tr15 includes a control electrode connected to the control node (Q-node), an input electrode connected to the clock terminal CLK, and an output electrode connected to a carry output node CR(N). When a high voltage is applied to the control node (Q-node), the carry unit 230 outputs the high-voltage clock signal CLK supplied to the clock terminal CLK as the N-th carry signal. The N-th carry signal is outputted through a terminal connected to the carry output node CR(N).

The carry pull-down unit 231 may discharge a voltage of the carry output node CR(N) to a second low voltage VSS2, and may include a seventeenth transistor Tr17. The seventeenth transistor Tr17 includes a control electrode connected to the Q-node pull-down unit 251, an input electrode connected to the second low voltage terminal VSS2, and an output electrode connected to the carry output node CR(N).

The Q-node pull-down unit 251 and the Q-node holding unit 252 sequentially discharge voltages of the control node (Q-node) to the first and second low voltages VSS1 and VSS2, in response to an N+1-th carry signal CR(N+1) and an output of an inverting node, respectively.

The Q-node pull-down unit 251 may have two transistors Tr9-1 and Tr9-2 are connected in series. Control electrodes of the (9-1)-th transistor Tr9-1 and the (9-2)-th transistor Tr9-2 are connected to the (N+1)-th carry signal CR(N+1), an input terminal of the (9-1)-th transistor Tr9-1 is connected to the Q-node, and an output terminal of the (9-2)-th transistor Tr9-2 is connected to the second low voltage VSS2.

When a high-voltage of the (N+1)-th carry signal is applied to the ($N_{+}1$)-th carry input terminal CR(N+1) during a (N+1)-th period, the (9-1)-th transistor Tr9-1 and the (9-2)-th transistor Tr9-2 discharge a voltage of the control node (Q-node) to the second low voltage VSS2. Then, a low voltage is applied to the (9-1)-th transistor Tr9-1 and the (9-2)-th transistor Tr9-2 during the remaining period, except for the (N+1)-th period.

The Q-node holding unit 252 holds the voltage of the control node (Q-node). The Q-node holding unit 252 includes a (10-1)-th transistor Tr10-1. The Q-node holding unit 252 may have a FRT structure in which two transistors Tr10-1 and Tr10-2 are connected in series. The (10-1)-th transistor Tr10-1 and the (10-2)-th transistor Tr10-2 include control electrodes connected to a inverting node N, one terminal of the (10-1)-th transistor Tr10-1 is connected to the Q-node, and the (10-2)-th transistor Tr10-2 is connected to the second low voltage terminal VSS2. The Q-node holding unit 252 holds the voltage of the control node (Q-node) to the second low voltage VSS2, in response to a signal of the inverting node N during the remaining period of the frame.

The output pull-down unit 261 pulls down the N-th gate signal G(N). The output pull-down unit 261 includes a second transistor Tr2. The second transistor Tr2 includes a control electrode to which the (N+1)-th carry signal is inputted, an input electrode connected to the output node G(N), and an output electrode connected to the first low voltage (e.g., the first voltage terminal) VSS1. When the (N+1)-th carry signal is inputted to the control electrode of the second transistor Tr2, the output pull-down unit 261 pulls down the voltage of the output node G(N) to the first low voltage VSS1.

The output holding unit 262 holds the voltage of the output node G(N). The output holding unit 262 includes a third transistor Tr3. The third transistor T3 includes a control electrode connected to the inverting node N, an input electrode connected to the output node G(N), and an output electrode connected to the first voltage terminal VSS1. The output holding unit 262 holds the voltage of the output node G(N) to the first low voltage VSS1, in response to the signal of the inverting node.

The inverter unit 270 may output a signal having the same phase as a clock signal that is received by the clock terminal CLK at the inverting node N during the remaining of the frame, except for the period during which the high voltage of the N-th carry signal is outputted. The inverter unit 270 includes a twelfth transistor Tr12, a seventh transistor Tr7, a thirteenth transistor Tr13, and an eighth transistor Tr8.

The twelfth transistor Tr12 includes a control electrode and an input electrode that are connected to the clock terminal CLK, and an output electrode that is connected to an input electrode of the thirteenth transistor Tr13 and a control electrode of the seventh transistor Tr7. The seventh transistor Tr7 includes the control electrode connected to the thirteenth transistor T13, an input electrode connected to the clock terminal CLK, and an output electrode connected to an input electrode of the eighth transistor Tr8. The output electrode of the seventh transistor Tr7 is connected to the inverting node N. The thirteenth transistor Tr13 includes a control electrode connected to the carry output node CR(N), an input electrode connected to the twelfth transistor Tr12, and an output electrode connected to the terminal of the second low voltage VSS2. The eighth transistor Tr8 includes a control electrode connected to the carry output node CR(N), an input electrode connected to the inverting node N, and an output electrode connected to the terminal of the second low voltage VSS2.

The inverter unit 270 discharges a clock signal inputted to the clock terminal CLK to the first low voltage VSS1, during a period in which the high voltage of the carry output node CR(N) is applied thereto. That is, the eighth and thirteenth transistors Tr8 and Tr13 are turned on in response to the high voltage of the carry output node CR(N), such that the clock signal is discharged to the second low voltage VSS2.

The carry holding unit 280 holds the voltage of the carry output node CR(N). The carry holding unit 280 includes an eleventh transistor Tr11. The eleventh transistor Tr11 includes a control electrode connected to the inverting node N, an input electrode connected to the carry output node CR(N), and an output electrode connected to the terminal of the second low voltage VSS2. The carry holding unit 280 holds the voltage of the carry output node CR(N) to the second low voltage VSS2 in response to the signal of the inverting node N during the remaining of the frame.

According to the gate driving circuit of FIG. 2, a discharge path of the output may be a path in which the first transistor Tr1 is pulled up and the second transistor Tr2 is pulled down. Since the Q-node is in a state of high voltage, a discharge path through the first transistor Tr1 is formed. In this case, since performance of the first transistor Tr1 may deteriorate or output pull-down time may increase due to Vth-threshold VT shift, the pixel data may be changed.

As will be described in more detail below with reference to FIG. 3, according to some embodiments of the present invention, the output pull-down transistor Tr2 may be omitted by improving the discharge of the Q-node, thereby implementing a circuit structure realizing a narrow bezel.

Figure 3:
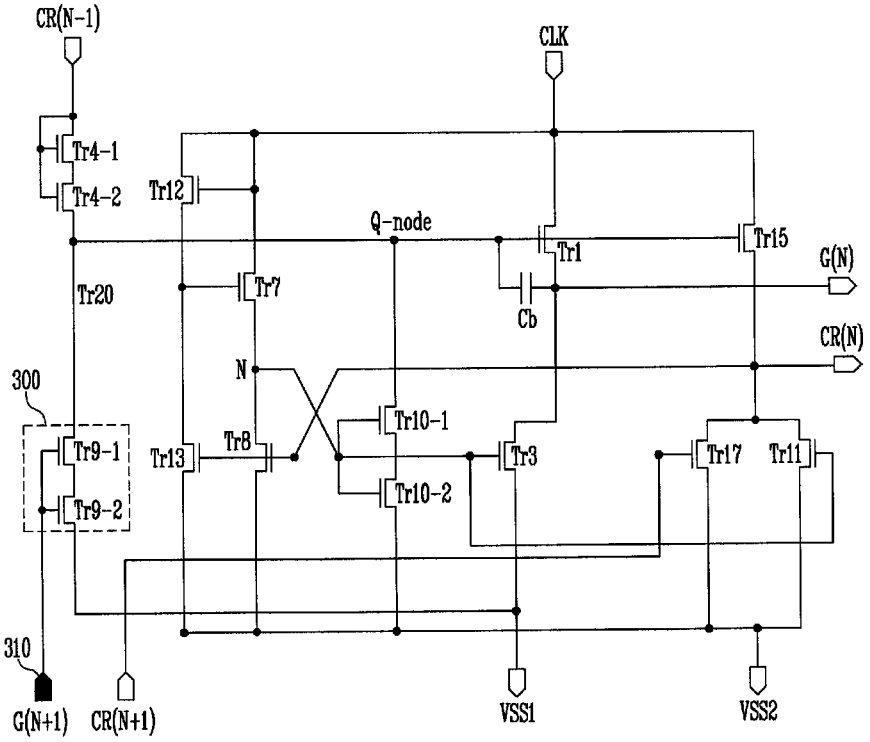
FIG. 3 illustrates a gate driving circuit diagram according to an exemplary embodiment.

FIG. 3 illustrates a gate driving circuit diagram according to an exemplary embodiment of the present invention.

Referring to FIG. 3, source voltages of a (9-1)-th transistor Tr9-1 and a (9-2)-th transistor Tr9-2 of a Q-node discharger 300 are coupled to a terminal of a first low voltage VSS1. Further, when a first transistor Tr1 forming a Q-node pull-up unit (e.g., a Q-node pull-up part) is discharged, a second low voltage VSS2 is inputted to a clock terminal CLK, so that the voltage of the Q-node may be discharged, for example, from about 35 V to about −11 V. Accordingly, driving voltages of the output pull-down transistors Tr9-1 and Tr9-2 may decrease.

Further, a (N+1)-th output signal G(N+1) is inputted to the gates of the (9-1)-th transistor Tr9-1 and the (9-2)-th transistor Tr9-2 of the Q-node discharger 300, instead of the (N+1)-th carry signal CR(N+1) of the gate driving circuit illustrated in FIG. 2. Accordingly, the output pull-down time may be longer than the carry pull-down time. Accordingly, the pull-down time is increased during the high voltage state of the Q-node.

The Q-node may be further discharged to the second low voltage VSS2 through the (10-1)-th transistor Tr10-1 and the (10-2)-th transistor Tr10-2 during a (N+2)-th period.

Referring to FIG. 3, since the output may be discharged through the first transistor Tr1 without the second transistor Tr2 of FIG. 2, which operates as an output discharger, the bezel size may be reduced.

Figure 4:
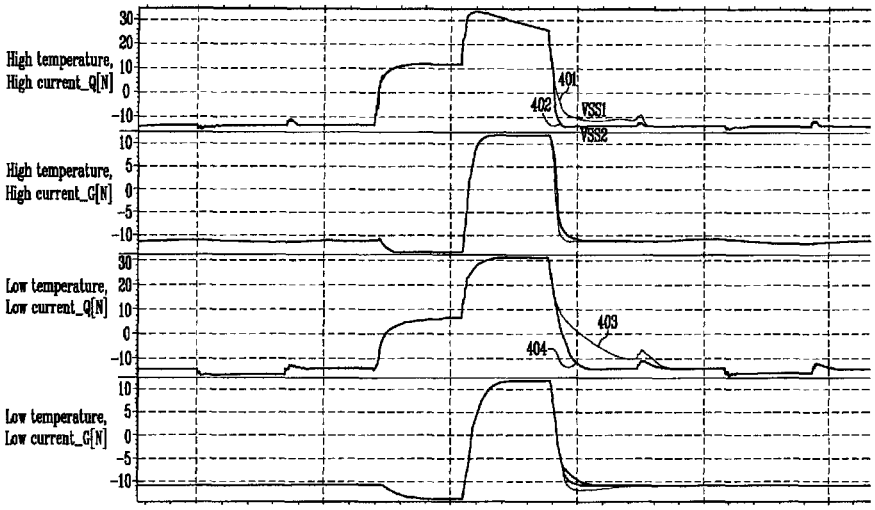
FIG. 4 illustrates graphs of simulation results of a gate driving circuit according to an exemplary embodiment.

FIG. 4 illustrates graphs of simulation results of a gate driving circuit according to an exemplary embodiment of the present invention.

Referring to FIG. 4, the pull-down of the Q-node proceeds from the second low voltage VSS2 to the first low voltage VSS1 when high temperature and high current are applied (401 and 402) and also when low temperature and low current are applied (403 and 404).

Accordingly, since the output pull-down time is longer than the carry pull-down time, the output is discharged through the first transistor Tr1, and the Q-node may further be discharged to the second low voltage VSS2 through the hold transistor during the (N+2)-th period.

Accordingly, a size of the bezel may be reduced by improving the discharge of the Q-node without including the second transistor Tr2.

Example embodiments have been disclosed herein and although specific terms are employed, they are used and are to be interpreted in a generic and descriptive sense only, and not for purpose of limitation. In some instances, as would be apparent to one of ordinary skill in the art as of the filing of the present application, that features, characteristics and/or elements described in connection with a particular embodiment may be used singly or in combination with features, characteristics and/or elements described in connection with other embodiments, unless otherwise specifically indicated.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Although the present invention has been described with reference to the example embodiments, those skilled in the art will recognize that various changes and modifications to the described embodiments may be performed, all without departing from the spirit and scope of the present invention. Furthermore, those skilled in the various arts will recognize that the present invention described herein will suggest solutions to other tasks and adaptations for other applications. It is the applicant's intention to cover by the claims herein, all such uses of the present invention, and those changes and modifications which could be made to the example embodiments of the present invention herein chosen for the purpose of disclosure, all without departing from the spirit and scope of the present invention. Accordingly, it will be understood by those of skill in the art that various changes in form and details may be made without departing from the spirit and scope of the present invention as set forth in the following claims, and their equivalents.

What is claimed is:

1. A gate driving circuit comprising a plurality of stage circuits configured to output a plurality of gate signals, a N-th stage circuit (N being a natural number) of the plurality of stage circuits comprising:

an output pull-up part including a control electrode connected to a first node, the first node being configured to have a potential increase in response to a (N−1)-th control signal received from a previous stage circuit of the N-th stage circuit, the output pull-up part being configured to receive a clock signal to output a gate signal of the N-th stage circuit;

a control node pull-up part configured to control the potential of the first node by using the (N−)-th control signal; and a control node pull-down part configured to discharge the first node to a first low voltage according to a (N+1)-th control signal, wherein the output pull-up part is configured to discharge the gate signal of the N-th stage circuit in a (N+2)-th stage circuit, wherein the N-th stage circuit further comprises an inverter part configured to output the clock signal to an inverting node during a remaining period excluding a period in which a high voltage of a N-th control signal is out putted, wherein the N-th stage circuit further comprises a carry pull-down part configured to discharge a carry output terminal to a second low voltage corresponding to the (N+1)-th control signal, and wherein a pull-down time of the output pull-up part is longer than a pull-down time of the carry pull-down part.

2. The gate driving circuit of claim 1, wherein the N-th stage circuit further comprises a carry part configured to output a high voltage of the clock signal as the N-th control signal when a high voltage is supplied to the first node.

3. The gate driving circuit of claim 1, wherein the N-th stage circuit further comprises a carry holding part configured to discharge the carry output terminal of a carry part to the second low voltage when the clock signal is supplied to the inverting node, the carry part being configured to output the N-th control signal.

4. The gate driving circuit of claim 1, wherein the N-th stage circuit further comprises a control node holding part configured to discharge the first node to the second low voltage when the clock signal is supplied to the inverting node.

5. The gate driving circuit of claim 1, wherein the N-th stage circuit further comprises an output holding part configured to discharge an output node configured to output the gate signal of the N-th stage circuit to a first low voltage when the clock signal is supplied to the inverting node.

6. The gate driving circuit of claim 1, wherein the control node pull-up part comprises a first transistor and a second transistor, gate electrodes of each of the first and second transistors being configured to receive the (N−1)-th control signal, and wherein an input electrode of the first transistor is configured to receive the (N−1)-th control signal, and an input electrode of the second transistor is configured to receive an output of the first transistor.

7. A display device comprising:

a display panel comprising:

a display area including a plurality of gate lines, a plurality of data lines, and a plurality of pixel transistors; and a peripheral area surrounding the display area;

a data driving circuit configured to output data signals to the data lines; and a plurality of stage circuits arranged at the peripheral area and configured to output gate signals to the gate lines, wherein each of the plurality of the stage circuits includes a gate driving circuit including a plurality of transistors, and wherein each of the plurality of the stage circuits comprises:

an output pull-up part including a control electrode connected to a first node, the first node being configured to have a potential increase in response to a (N−1)-th control signal received from a previous stage circuit of a N-th stage circuit, and the output pull-up part being configured to receive a clock signal to output a gate signal of the N-th stage circuit;

a control node pull-up part configured to control the potential of the first node by using the (N−1)-th control signal; and a control node pull-down part configured to discharge the first node to a first low voltage according to a (N+1)-th control signal, wherein the output pull-up part is configured to discharge the gate signal of the N-th stage circuit in a (N+2)-th stage circuit, and wherein a gate electrode of a transistor of the control node pull-down part is connected to an output of a transistor with a slowest discharge speed among a plurality of transistors connected to the first node.

8. The display device of claim 7, wherein the pixel transistors of the display area and the transistors of the gate driving circuits each include an oxide semiconductor.

9. A display device comprising:

a display panel comprising:

a display area including a plurality of gate lines, a plurality of data lines, and a plurality of pixel transistors; and a peripheral area surrounding the display area;

a data driving circuit configured to output data signals to the data lines; and a plurality of stage circuits arranged at the peripheral area and configured to output gate signals to the gate lines, wherein each of the plurality of the stage circuits includes a gate driving circuit including a plurality of transistors, wherein each of the plurality of the stage circuits comprises:

an output pull-up part including a control electrode connected to a first node, the first node being configured to have a potential increase in response to a (N−1)-th control signal received from a previous stage circuit of a N-th stage circuit, and the output pull-up part being configured to receive a clock signal to output a gate signal of the N-th stage circuit;

a control node pull-up part configured to control the potential of the first node by using the (N−1)-th control signal; and a control node pull-down part configured to discharge the first node to a first low voltage according to a (N+1)-th control signal, wherein the output pull-up part is configured to discharge the gate signal of the N-th stage circuit in a (N+2)-th stage circuit, and wherein the gate driving circuit comprises the output pull-up part, the control node pull-up part, and the control node pull-down part, and a discharging time of the gate signal of the gate driving circuit is longer than a pull-down time of the control signal.

10. The display device of claim 9, wherein the pixel transistors of the display area and the transistors of the gate driving circuits each include an oxide semiconductor.

* * * * *